US007560652B2

(12) United States Patent
Albrecht et al.

(10) Patent No.: US 7,560,652 B2
(45) Date of Patent: Jul. 14, 2009

(54) ELECTRICAL CONTACT WITH REDUNDANT PATHS

(75) Inventors: Kenneth A. Albrecht, Zion, IL (US); Richard W. Fitzgerald, Franklin, WI (US)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 11/681,583

(22) Filed: Mar. 2, 2007

(65) Prior Publication Data

US 2008/0217146 A1 Sep. 11, 2008

(51) Int. Cl.
*H01H 15/06* (2006.01)

(52) U.S. Cl. ..... 200/16 B; 200/541

(58) Field of Classification Search ..... 200/61 B, 200/260, 541, 550

See application file for complete search history.

(56) References Cited

U.S. PATENT DOCUMENTS 3,485,966 A * 12/1969 Lutzenberger et al. .... 200/16 D
3,601,727 A * 8/1971 Hults ..... 335/205
3,912,887 A * 10/1975 Gratz et al. ..... 200/16 D
4,053,726 A * 10/1977 Schaad ..... 200/534
4,324,958 A * 4/1982 Valleau ..... 200/16 F
4,326,110 A * 4/1982 Zdanys, Jr. ..... 200/16 R
4,335,287 A * 6/1982 Aschenbach et al. ..... 200/302.3
4,342,885 A * 8/1982 Kashima et al. ..... 200/47
4,467,160 A * 8/1984 Murmann et al. ..... 200/536
4,725,702 A * 2/1988 Kamisada ..... 200/254
4,736,081 A * 4/1988 Sorrells ..... 200/525
4,778,964 A * 10/1988 Kamisada ..... 200/284
4,851,619 A * 7/1989 Fujita et al. ..... 200/6 R
4,886,946 A * 12/1989 Franks, Jr. ..... 200/329
5,008,505 A * 4/1991 Takano et al. ..... 200/531
5,221,816 A 6/1993 Williams
5,528,007 A 6/1996 Williams et al.
5,813,522 A * 9/1998 Lin ..... 200/550
7,060,917 B1 6/2006 Park
7,323,957 B2 * 1/2008 Menard et al. ..... 335/80

* cited by examiner

*Primary Examiner*—Michael A Friedhofer
*Assistant Examiner*—Lisa N Klaus
(74) *Attorney, Agent, or Firm*—K & L Gates LLP

(57) ABSTRACT

Angled spring contacts and switches made with contactors containing angled spring contacts are disclosed. The housing for the angled spring contacts has a generally cylindrical shape. The contacts are contained within the housing with their ends extending from the housing on either side. The contacts are formed by making bullet-shaped internal contacts that are joined by a spring. The spring is mounted to the two contacts to urge the two contacts away from each other at an angle to a longitudinal axis of the housing. This angle forces contact between each contact and the housing in at least two places, thus creating redundant paths between the contacts. Switches, such as plunger switches having a normal or OFF position, and an actuated or ON position, may be made with one or more angled spring contacts. The contacts have separate surfaces for electrical conduction and for arcing.

20 Claims, 12 Drawing Sheets

ELECTRICAL CONTACT WITH REDUNDANT PATHS

BACKGROUND

The field of the invention is electrical contacts and electrical switches that use such contacts.

Electrical switches have now been in general use for over a hundred years, and have become reliable and commonplace for household and other uses. In applications where higher power, current or voltage is in use, however, some problems of switches have also become commonplace. These problems can include wear and erosion of switch contacts, usually when the switches and contacts are in use for many thousands of operations over an extended period of time.

Erosive wear on contacts may occur when a dc switch is being either opened or closed, but is generally most severe when the switch is being opened and the switch contacts draw apart. When the contacts draw apart, the reduction in contact pressure and resulting increase in resistance between the contact surfaces leads to a significant increase in temperature in the zone of contact. Localized melting of the contact material may occur, and an arc may form between the contacts. An arc may cause erosion of the contacts, and eventually lead to pitting, excessive wear, and even mechanical failure. Another possibility for erosive wear occurs when the switch does not reliably hold the contacts in position and "chatter" or high frequency movement between the contacts causes momentary opening and additional arcing.

As a result of these problems, switches may be designed to lessen the arcing and chatter that causes erosive wear and failure. Thus, switch contacts may be made from sturdy and reliable designs with high copper content for minimum resistance and maximum reduction of localized heat. Contacts may be alloyed with silver or other metals to minimize the effects of arcing. Contacts may also be spring-loaded, i.e., kept in contact by a spring loaded in compression as part of the contacts circuit.

An example of efforts to minimize wear and pitting is disclosed in U.S. Pat. No. 5,221,816. This patent discloses a plunger switch using a bent wiper contact that is held in compression between a common terminal and a normally closed (NC) or a normally open (NO) terminal. The wiper is in the general shape of a U or V that has been bent even further wide open. The outer legs are mounted on or insert molded into a plastic retainer that moves with the plunger. However, in use, these contacts are easily eroded by arcing and fail in service. Without being bound to any particular theory, it is believed that the wipers may be unevenly loaded between the contacts. It is also possible that their relatively thin, two-dimensional nature does not provide enough contact material compared to what is needed to survive erosive wear.

In another example, U.S. Pat. No. 7,060,917 discloses a plunger switch that uses a hollow bushing or plate to make or break electrical contact between upper NO contacts and lower NC contacts. Internal springs urge the plunger upward for making contact with the NO contacts while the exterior of the switch is molded to include a hook-engaging portion so that a hook may be used to keep the switch actuated (closed). Engagement of the internal portions of the contacts depends on proper assembly and the alignment and force of the springs. Over time, it appears that this switch also will be subject to uneven wear and arcing as the springs relax and as the plate is deformed.

What is needed is a switch with contacts that are resistant to arcing and with sufficient heft and mass to resist nominal pitting or wear resulting from operation of the switch. The contacts should have low resistance to current and voltage and high reliability.

SUMMARY

Embodiments of the present invention provide such contacts and a switch that uses such contacts. One embodiment is a switch with a plurality of contactors. The switch includes a switch housing, a fixed contactor mounted to the switch housing, the fixed contactor comprising at least one each of NC, NO and common terminals, a plunger slidably mounted to the switch housing, and a movable contactor housing connected to the plunger, the moveable contactor housing further including a plurality of contactors, each contactor having a conductive housing, first and second metallic conductors captured at an angle within the conductive housing, a portion of each of the first and second conductors extending beyond the housing, the first and second conductors joined to a spring having first and second ends, the conductive housing and the contactors forming redundant electrical paths, wherein a position of the plunger determines connections made by the contactors between the terminals.

Another embodiment is a switch with a plurality of contactors. The switch includes a switch housing, a fixed contactor mounted to the switch housing, the fixed contactor comprising at least one each NC, NO and common terminals, a plunger slidably mounted to the switch housing, and a movable contactor housing connected to the plunger, the contactor housing further including a plurality of contactors, each contactor having a conductive housing, first and second metallic conductors captured within the conductive housing and joined to first and second ends of a spring inside the conductive housing, the conductors at an angle to a longitudinal axis of the conductive housing and a portion of each of the first and second conductors extending beyond the conductive housing, the conductive housing and the conductors forming redundant electrical paths, wherein a position of the plunger determines connections made by the contactors between the terminals.

Another embodiment is an electrical contactor for use in a switch. The electrical conductor includes a conductive housing, a spring with first and second ends within the housing, and it also includes first and second metallic conductors captured within the housing and partly extending beyond the housing, the conductors at an angle to a longitudinal axis of the conductive housing and joined to the first and second ends of the spring, the housing and the conductors forming redundant electrical paths. The spring urges the first and second metallic conductors against the housing.

Another embodiment is a method of making an electrical contactor useful in switches. The method includes steps of forming a metallic spring having first and second ends, joining first and second metallic conductors to the first and second ends, the metallic conductors optionally comprising an internal mounting tang. The method also includes inserting the spring and the first and second metallic conductors into a conductive housing; and deforming the housing to retain the spring and the conductors within the housing, wherein the first and second metallic conductors are retained at an angle to a longitudinal axis of the conductive housing and wherein the conductors partly extend beyond the housing.

Additional features and advantages are described herein, and will be apparent from, the following Detailed Description and the figures.

DETAILED DESCRIPTION OF THE PRESENTLY PREFERRED EMBODIMENTS

The Contactors

Contactors with internal conductors at an angle to the conductor help to avoid the adverse effects of arcing and erosion in two ways. The spring loading of the contacts helps to insure even, uniform contact between the contactor and the terminals, thus minimizing contact resistance and subsequent heat build-up. In addition, the angled conductors provide two electrical paths between the common and the normally open and normally closed (NO/NC) portions of the contactor. The first path is that provided by the contacts and the spring. The second path is that between the conductors and the conductive housing. Keeping the contacts always canted or at an angle within the housing insures there are always two points or areas of contact between each of the contact ends and the housing that contains the contact ends. Finally, the bullet-shaped contacts or conductors preferably have working ends that are roughly hemispherical. This shape provides more metal in a stronger shape than the flat shapes previously used. Even if erosive arcing occurs, there is much more metal on the contact that must be worn away before contacts fail. Accordingly, our tests have shown that the contactors with internal conductors at an angle provide much longer life than previous products.

Tests have shown that under a 12 Volt, 4 Amp highly inductive dc load, switches with contactors having internal angled contacts as described herein provide a life of more than 100,000 make/break cycles. Contacts described in the prior art failed at 20,000 cycles or less.

Figure 1:
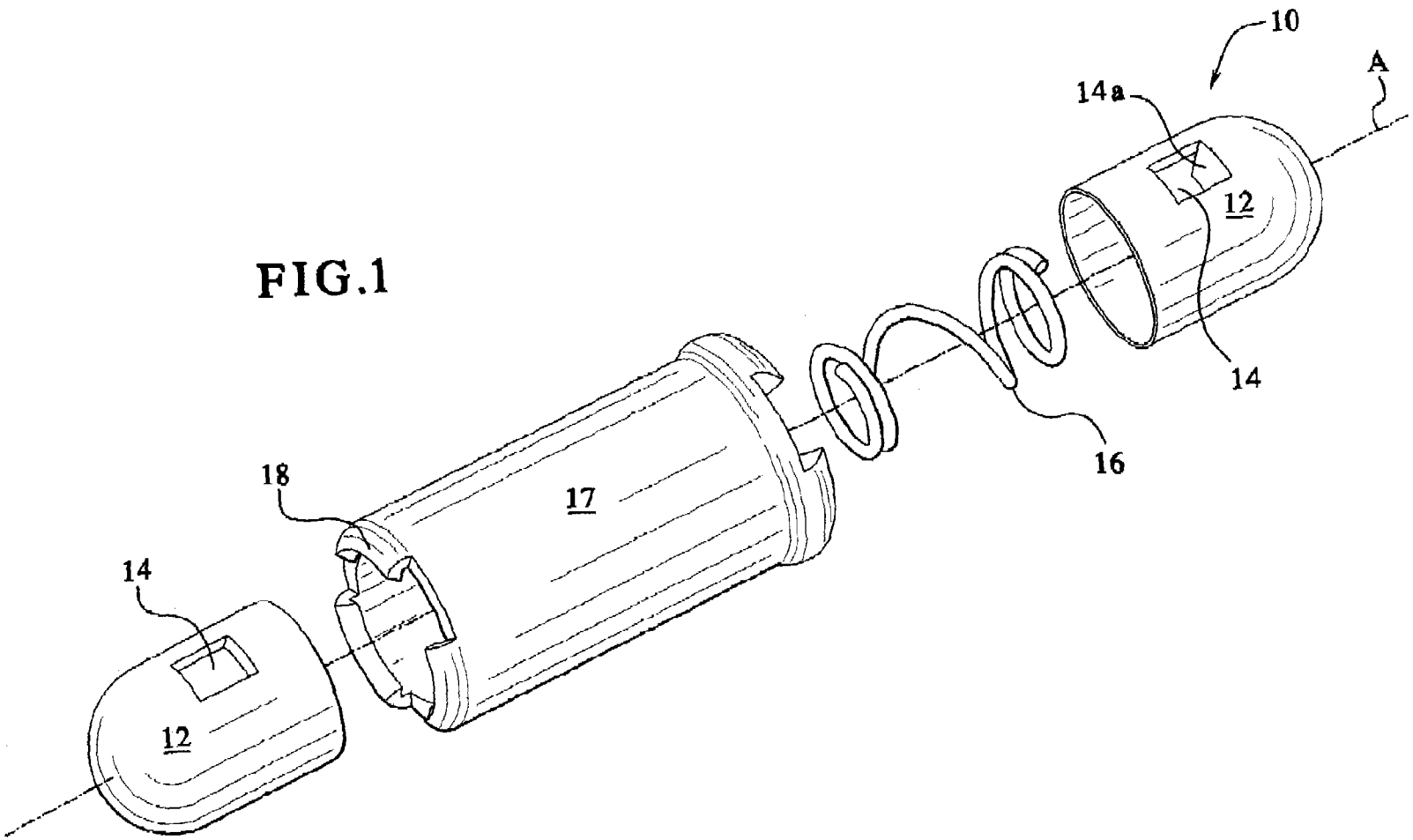
FIG. 1 depicts an exploded view of a contactor with internal conductors at an angle.
Figure 2:
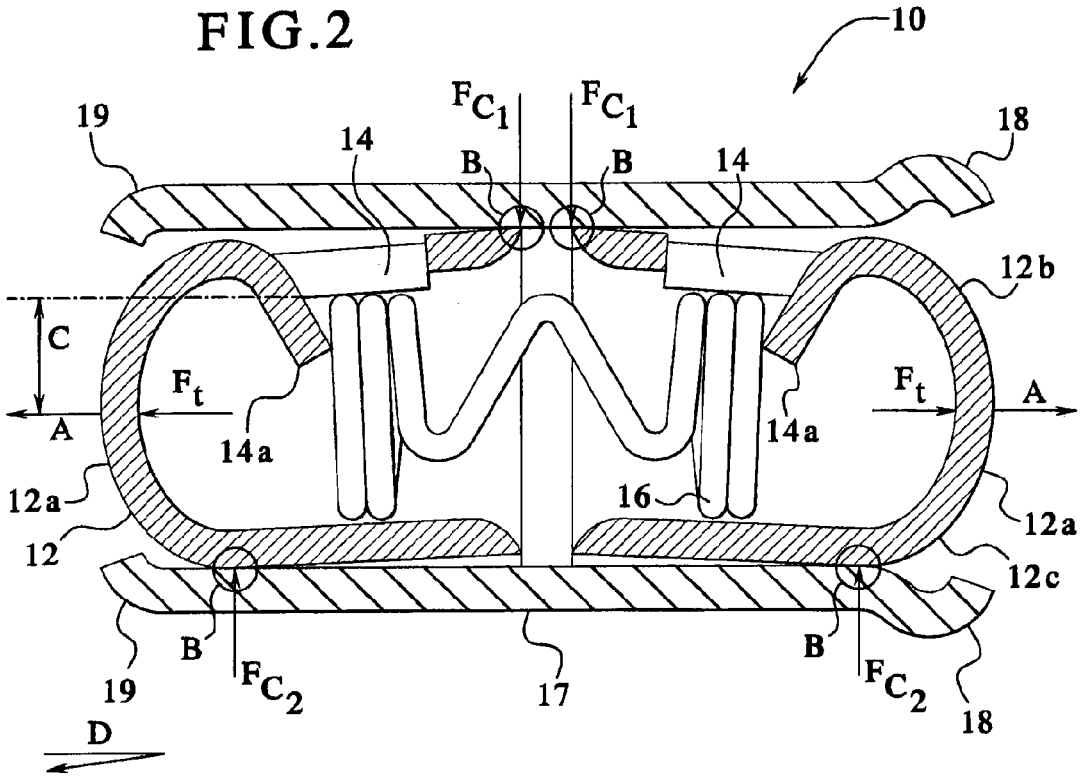
FIG. 2 depicts a cross-section of the contactor of FIG. 1.

Contactors with internal conductors at an angle, one embodiment of which is depicted in FIGS. 1-2, are useful in a variety of switches and switching applications. This embodiment of a contactor 10 includes two bullet-shaped contacts 12, each with a void or mounting space 14. The mounting space 14 is intended for ease of assembly with ends of a spring 16. The mounting space is on the periphery of the contact, and thus is off the center of a longitudinal axis A of both the contacts and a conductive housing 17. The radial distance from the center of the contact housing 17 to the ends of the spring is represented by distance C. The overall shape of the contacts is roughly the shape of a rounded bullet, with a generally hemispherical end portion, rather than a more sharply-pointed bullet shape. Without being bound to any particular theory, it is believed that this shape helps to reduce frictional forces when sliding the bullet-shaped contact from one stationary terminal to another, and to maximize localized contact force/pressure once electrical contact is made. The hemispherical shape further helps to prolong the life of the contact by providing physical separation distance from the working, or steady state electrical load carrying surface near the axis and the arcing zone, or first/last-point-of-contact as the contact makes or breaks from the terminal.

Contact 12 is preferably made by stamping a copper alloy, including a step of creating a mounting space or void. If the contact is made by stamping, rather than by machining, the metal previously occupying the space will be forced inwards, creating a tang 14*a*. The tang 14*a* will react the force exerted on contact 12, urging contact 12 away from housing 17, on both sides of the housing. Housing 17 is preferably brass or other cost-effective, conductive alloy.

Because the void and the tang are on only a small portion of the periphery of the contact, the force applied to the contact by the spring will necessarily be off center, i.e., a distance away from longitudinal axis A. This force is applied to both contacts, and thus the force applied to both contacts will be off-center. The force of the contacts applied to one side of the housing is represented by $Fc_1$, and on the other side by $Fc_2$. The distance between the points of contact on one side, $Fc_1$, create a coupling force that is reacted on the opposite side. The longitudinal or axial force exerted by the spring against the crimped ends of the housing is equal to the force required to retain the contacts, and is represented as Ft on either end. Accordingly, the spring will cock or cant the contacts off the longitudinal axis A. Thus, when the contactor 10 is assembled, contacts 12 will be at an angle to housing 17, as shown in FIG. 1 by angle D from horizontal.

The situation is depicted in FIG. 2, a cross-sectional view of the angled contacts and contactor of FIG. 1. As shown in FIG. 2, compression spring 16 applies an off-axis force to the two bullet-shaped contacts 12. Two coils of each end of spring 16 are assembled near the tang 14*a* and void or mounting space 14 that were made in forming contacts 12. The coils may be simply inserted into the spaces if the spaces are sufficiently tight to create a small interference fit with the coils. Alternately, the coils may be permanently assembled to the contacts, or the tangs of the contacts, by a method such as welding, brazing, or soldering. The contacts are thus biased off center, i.e., the contacts are urged off-axis by the spring and thus are canted or cocked within the housing. The outer surface of housing 17 normally is smooth, so that the contact may be press fit into the moveable contacts plunger housing. It may instead be useful to include transverse retainers or other features (not shown) on an exterior of housing 17 in order to better retain the contacts 10 in a housing that holds the contacts. Such retainers will prevent longitudinal (axial) movement of the contact and will also prevent rotation of the contact, thus holding the contact more firmly in place.

Accordingly, the spring-loaded contacts will be in electrical contact with the housing in at least two places, as shown by the circled portions B in FIG. 2. The intended use of contactor 10 is to provide electrical conductivity from one contact 12 to the other. Accordingly, the angled assembly of the contacts within conductive housing 17 provides at least two conductive paths between the contacts. The first path is from one contact through the spring to the other contact. The second path is from one contact, to and through the housing, to the other contact. Thus, redundant paths are formed through the contacts.

The purpose of the contacts is to prevent electrical arcing or wear to the greatest extent possible. It is believed that the force of the spring and the moveable nature of the contacts will urge the faces of the contacts into physical and electrical contact with other devices, such as the terminals discussed below, common, normally open, and normally closed terminals. The common terminal is essentially a continuous bar of copper or other conductor, and electrical contact with the common terminal does not change with the switch and plunger are activated or deactivated. Accordingly, area 12*a*, the central area of contact 10, and on the left side, is expected to provide the working surface for a contact used against a common terminal. Following the usual terminology, the contact in FIG. 2 is used in a switch that is pulled up to activate the switch and pushed back down to deactivate. An unactivated switch in the "normal" state will have "normally closed" terminals whose last electrical contact is with the lower contact portion, area 12*c*, and will thus tend to have arcing on this side of the contact when the switch is actuated. An activated switch in the "on" state that is then de-actuated will have its last electrical contact with the upper portion of contact 10, area 12*b*, and will have arcing or wear in that area.

The functional endurance of the angled-bullet contact against the effects of arcing is enhanced by the fact that the working, or steady-state electrical load carrying surface 12*a* is separated by a distance from the arcing zone during contact make or break areas 12*b*, 12*c*. Thus, even though erosion occurs in the arcing zones, it will not affect the load-carrying ability of the contact until sufficient erosion or pitting has occurred to reduce or otherwise damage the load carrying zone 12*a*.

Figure 3:
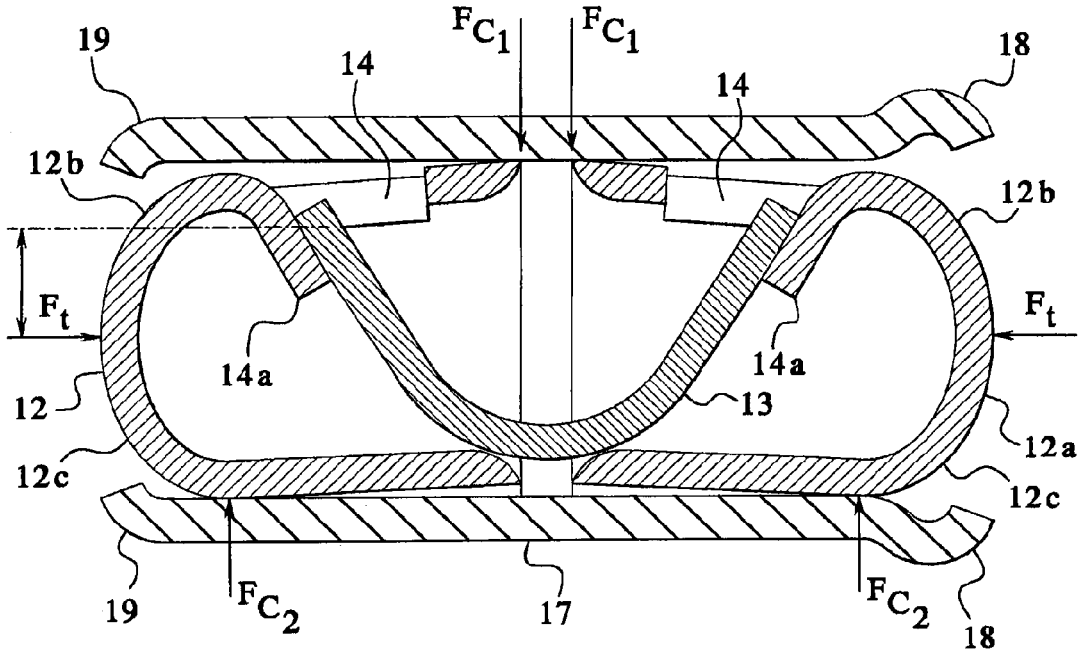
FIG. 3 depicts a cross-sectional view of an alternate contact assembly.

Compression springs, made of stainless steel, as shown in FIG. 2, are preferred but are not the only way to cant the contacts off-center. For example, a leaf spring, reliably mounted to the contacts, will also work to insure that contacts 12 are always canted off-center, maintaining electrical contact via two paths. An example of an angle contactor with a leaf spring 13 is depicted in FIG. 3, maintaining redundant contact paths through the contactor, and with all other elements of the contactor being the same. While stainless steel is preferred, other conductive and reliable materials, such as alloys of steel, copper or aluminum, may also be used. In a similar manner, cost effective brass, such as alloy C230, is preferred for the housing material, but other reliable, conductive, and cost-effective materials may also be used. C110 copper (alloy 11000) is preferred for the bullet-shaped contacts, but other suitable conductive materials may be used, such as other brass, copper or even aluminum or silver alloys.

Figure 4:
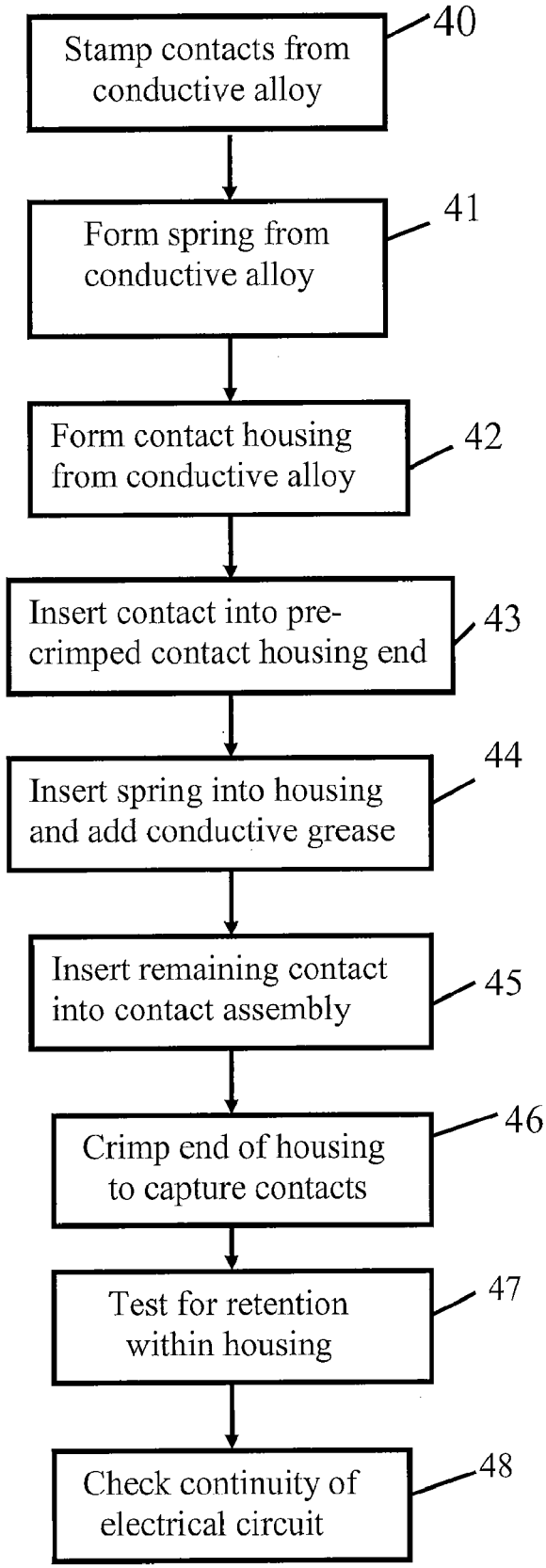
FIG. 4 depicts a flow chart for a method of assembling a contactor.

A canted, off-center electrical contactor, as described above, may be made by many processes. One such process is described in the flowchart of FIG. 4. Two contacts, preferably bullet-shaped, are stamped 40 from a conductive alloy as described above. The stamping may include two or more steps, such as a first step to form a contact that is rounded on one end and open on the other, and a second step to create a mounting area and tang. Other stamping or forming processes may be used. The spring that will be assembled to the two contacts is also formed 41, preferably from a stainless steel alloy. Coiled springs may be wound and shaped on a mandrel or otherwise cold-formed. If leaf springs are used, they may be stamped or otherwise formed, usually from flat (rectangular) stock rather than the round wire typically used for torsion springs. A contact housing is also formed 42 from a conductive alloy, such as brass or copper. The conductive housing for the assembled contacts is preferably formed by stamping. One of the contacts is then inserted 43 into the contact housing. One end of the housing is preferably pre-crimped, i.e., crimped before any other parts are assembled to the housing. The first contact is preferably inserted into the non-pre-crimped end and pushed to the crimped end, which prevents the contact from leaving the housing. As noted, the end-coils of the spring may be inserted with an interference fit into attachment spaces in the contacts. It is preferable to permanently attach the contacts to the spring by brazing, soldering, or welding. Since these are electrical contacts, and they may become warm, welding is preferred.

The spring is then inserted 44 into the contact housing and, optionally, conductive grease is added to the contact assembly. An example of a conductive grease is "Silver Filled Conductive Grease," from SPI Supplies, West Chester, Pa., USA. Another grease that may be used is 789 DM Grease, available from Nye Lubricants, Fairhaven, Mass., USA. The other contact is then inserted 45 into the contact assembly, preferably by joining the other contact firmly to the spring. After insertion, the other end of the housing is also crimped 46 to capture the contacts. After assembly, it is prudent to test 47 the contactor for secure assembly and retention of the contacts within the housing. Finally, a test is conducted 48 to insure the continuity of the electrical circuit through the contactor. As will be readily apparent to those having skill in the art, applying a voltage or current to several areas, and then checking for voltage drops across the possible paths will determine the relative resistance of the paths through the contactor.

Switches Using the Contactors

The contactors as described above have a great variety of applications, due to their reliable mechanical construction and thus their resulting electrical reliability. The contactors may be used in a great variety of switch applications. One application is a plunger switch in which a single contactor is used to connect a common terminal, sequentially, with a normally-closed contact and a normally-open contact. Such a plunger switch is typically used to operate several electrical devices and thus controls two or three, or even more circuits.

Figure 5:
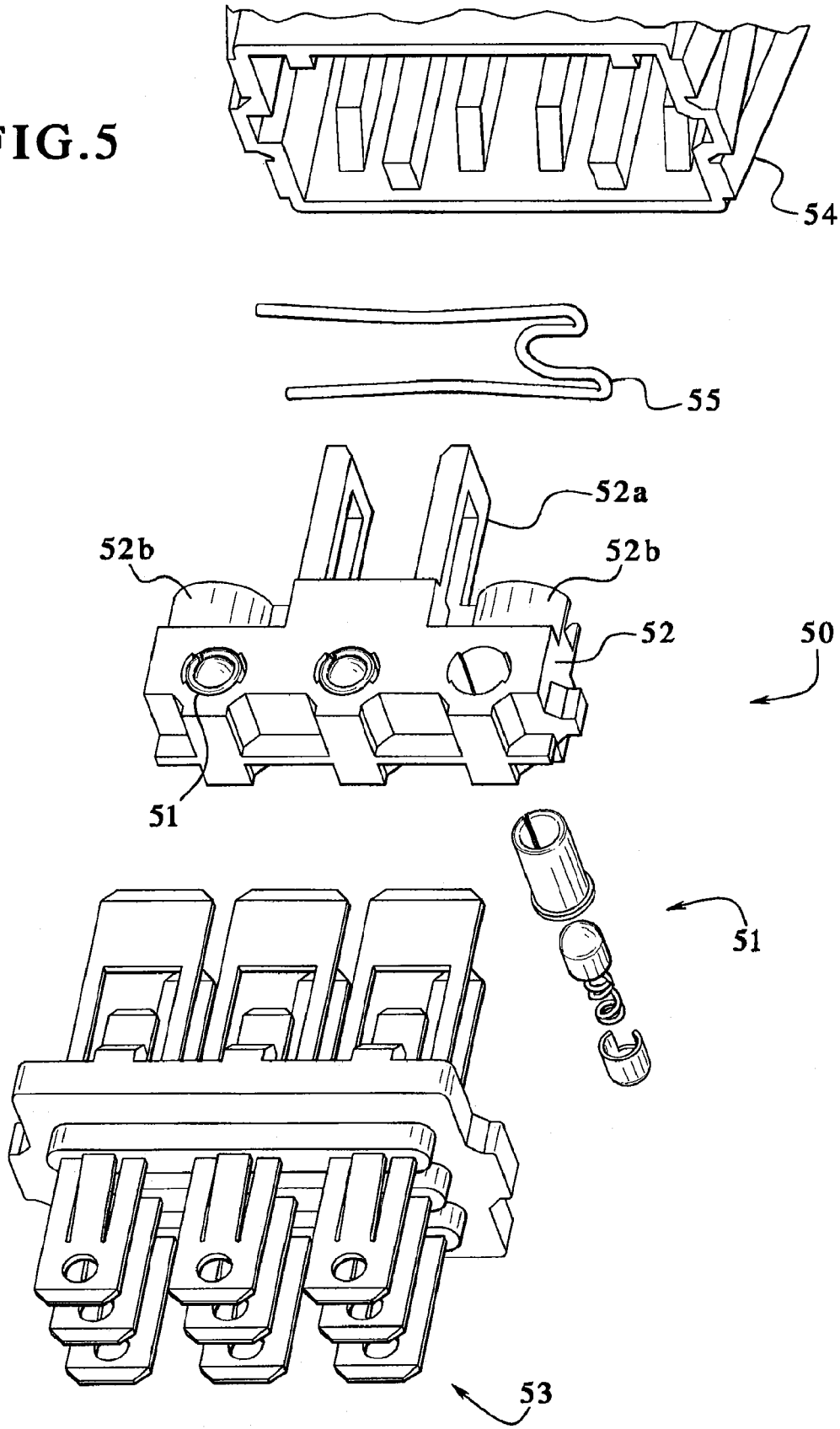
FIG. 5 depicts an exploded view of a switch incorporating contactors with angled internal conductors.

A typical plunger switch using contactors with internal conductors at an angle is depicted in FIG. 5. The switch 50 includes one or more contactors 51, the contactors press fit or molded into a moveable contactor housing 52 attached to a hand-operated plunger 56. The contactors make or break contact between terminals that are molded into a fixed contactor 53 mounted to a switch housing 54. A clip 55 may be used to retain the plunger in a fixed position with respect to the fixed contactor and housing, as will be described below.

Figure 6:
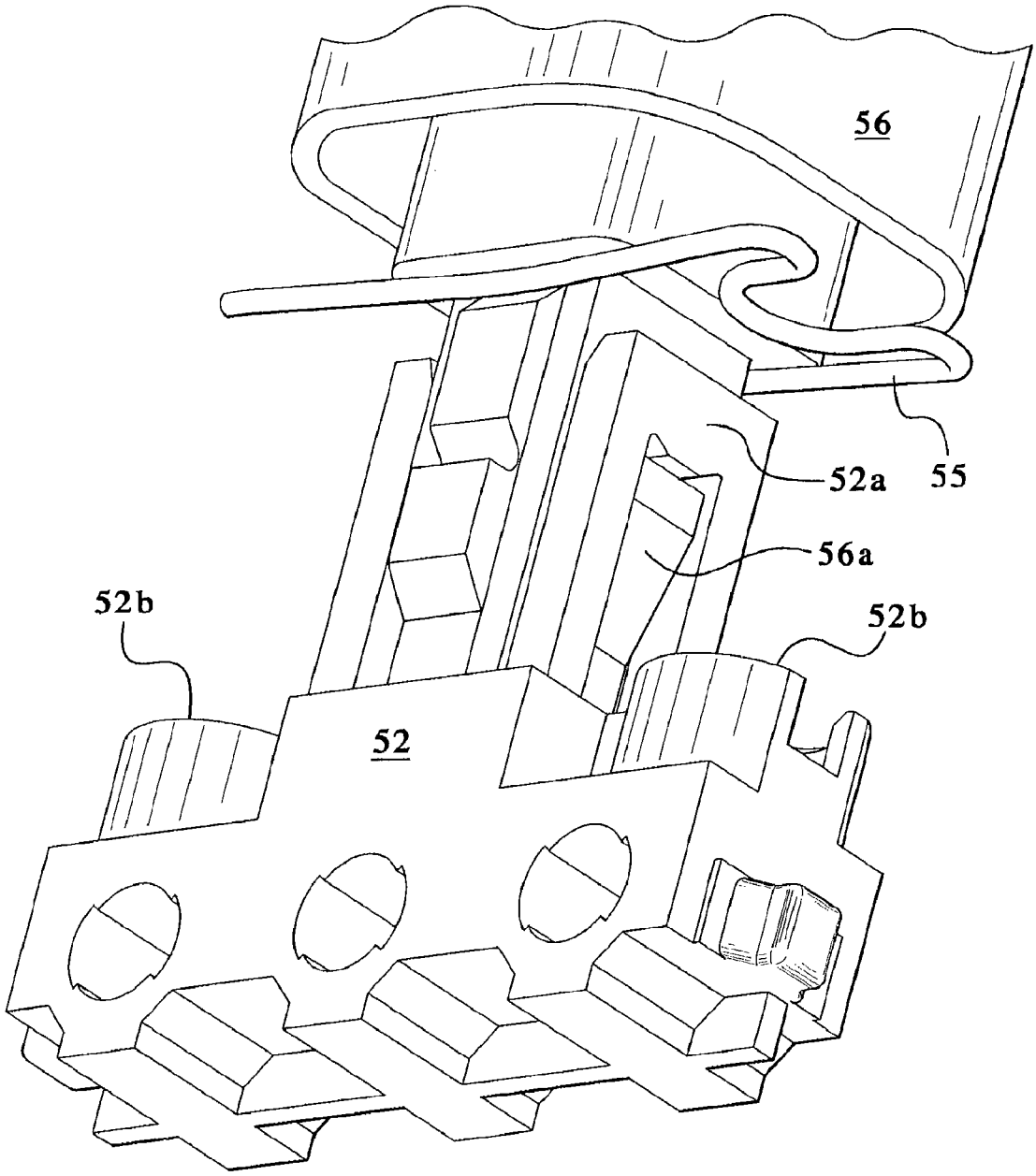
FIG. 6 depicts details of detents and retainers for a two-position plunger switch.

Moveable contact housing 52 is preferably made by press-fitting contactors 51 into a suitable non-conductive material, such as a phenolic, nylon, ABS, polypropylene, polycarbonate, or other temperature resistant material. In the embodiment depicted in FIGS. 5-6, the moveable contact housing 52 has female snap-fit connections 52*a* for permanent assembly to male snap-fit connections 56*a* of plunger 56. Moveable contact housing 52 also has two bosses 52*b* for mounting return springs between housing 52 and the upper, inner surface of switch housing 54. Moveable contact housing 52 is intended for controlled movement of contactors 51 among the fixed contacts within fixed contactor housing 53.

Figure 7:
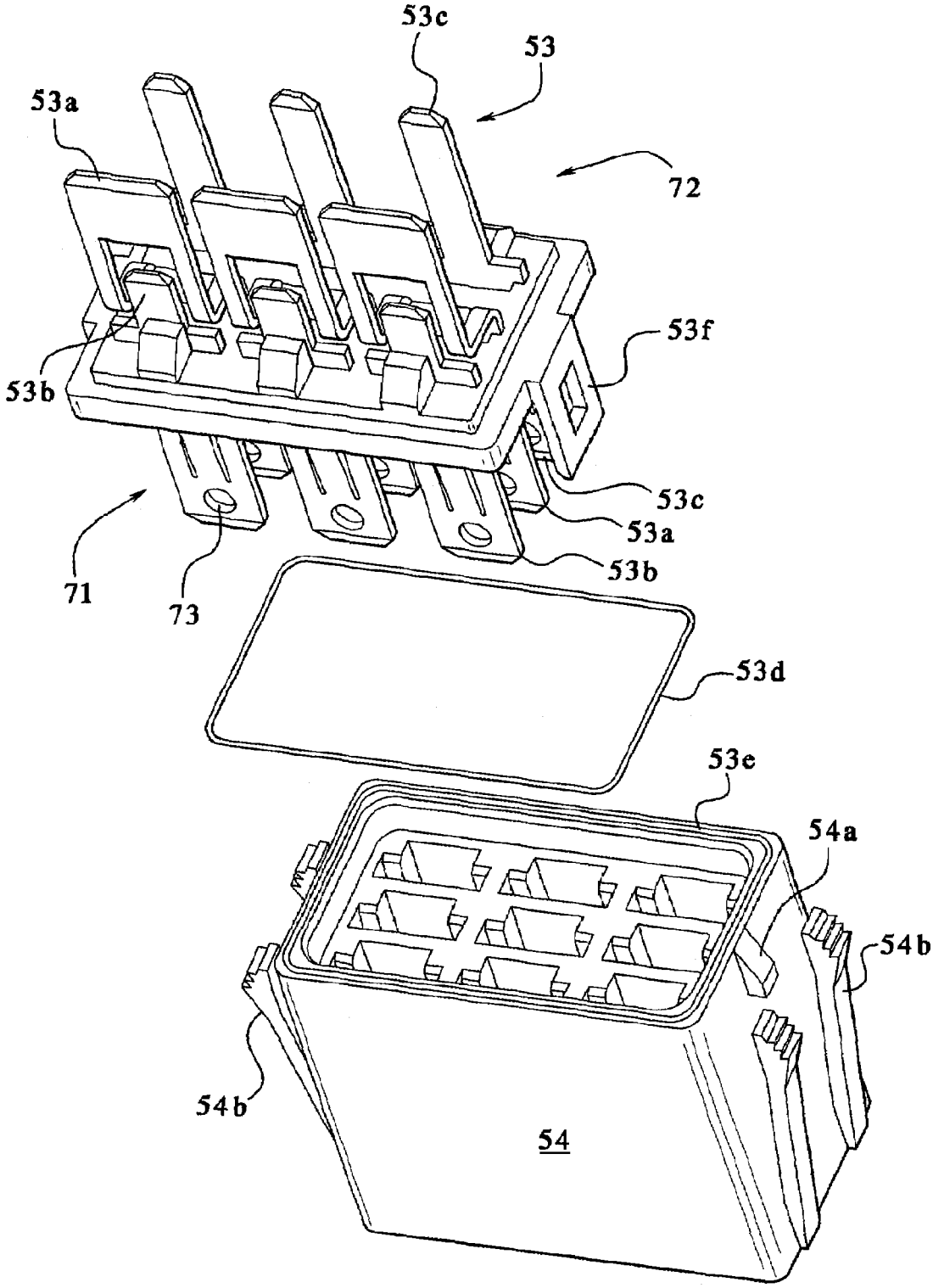
FIG. 7 depicts a switch housing and a fixed contacts useful in switches and plunger switches.

When assembling the switch, fixed contact assembly 53 is preferably sonic welded into switch housing 54. In FIG. 7, this is accomplished with female portions of the sonic weld joint 53*f* on the fixed contact assembly 53 and male portions of the sonic weld joint 54*a* on the housing assembly. Switch housing 54 itself is preferably mounted, by other mounting clips 54*b*, into an instrument panel or control module using the switches. Fixed contact assembly preferably includes a groove 53*d* for sealing against the switch housing. The assembled switch may include an O-ring 53*e* in the groove to prevent ingress of humidity, moisture or fluids.

The contacts for the fixed contact assembly include the external portions 71, shown at the bottom of fixed contactor housing 53 of FIG. 7, as well as the internal portions 72, shown in the upper portion of fixed contactor housing 53. The external portions typically have apertures 73 for further connections. In this embodiment, the fixed contacts include normally open (NO) contacts 53*a*, normally closed (NC) contacts 53*b*, and common contacts 53*c*. In this embodiment, the switch is in the normal (off) or non-actuated position when the plunger is pushed inwardly. Contactors 51 are normally in contact with the common contacts at all times. When the plunger is pushed inwardly, the switch is in the normal or off, non-actuated position, and the contactors are not in electrical contact with the NO contacts and the contactors are in electrical contact with the NC contacts. When the plunger is pulled out, the switch is deemed actuated or on. Electrical contact is then provided between the common terminals and the NO terminals, and is interrupted between the common terminals and the NC terminals.

Switch Operation

Figure 8:
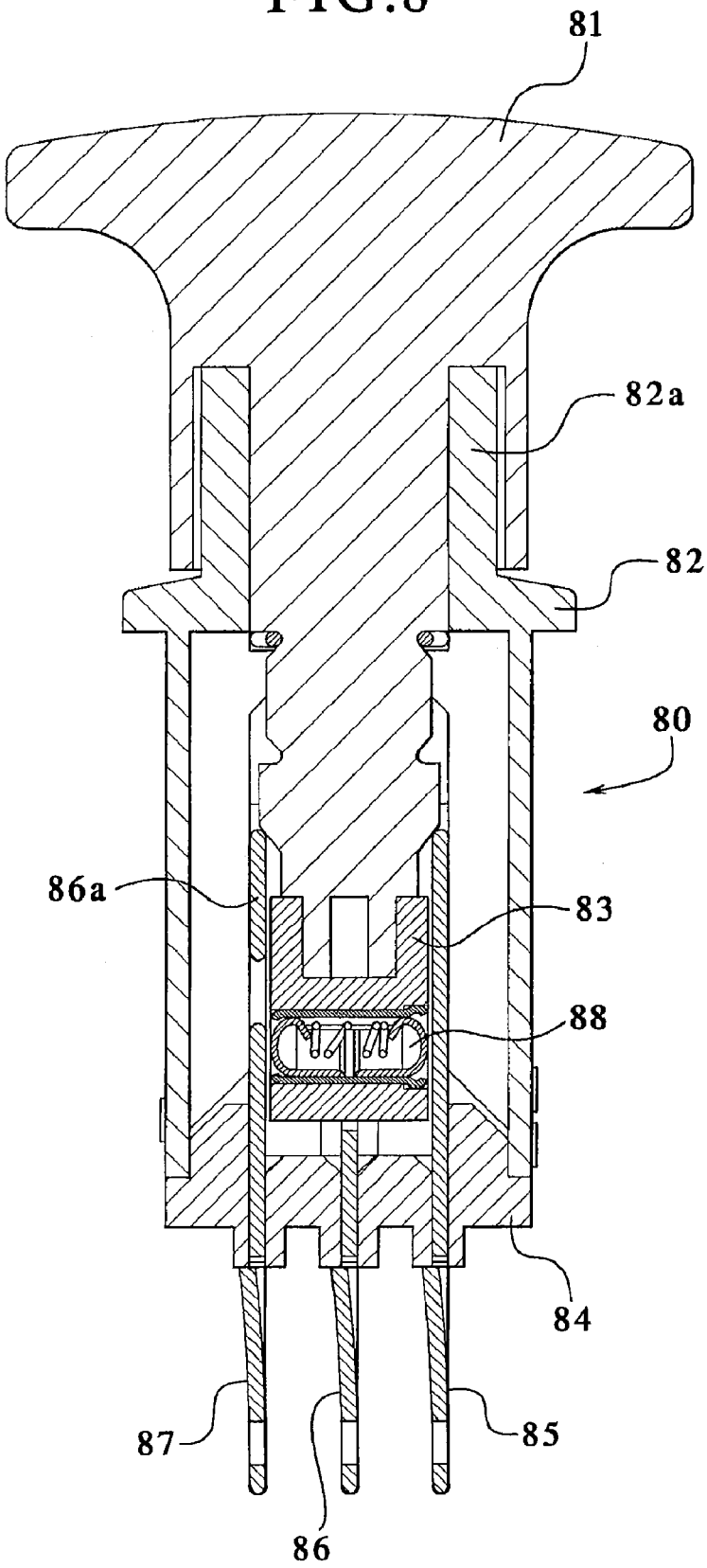
FIGS. 8-10 depict cross-sectional views of the operation of a contactor with internal angled conductors in a plunger switch.
Figure 9:
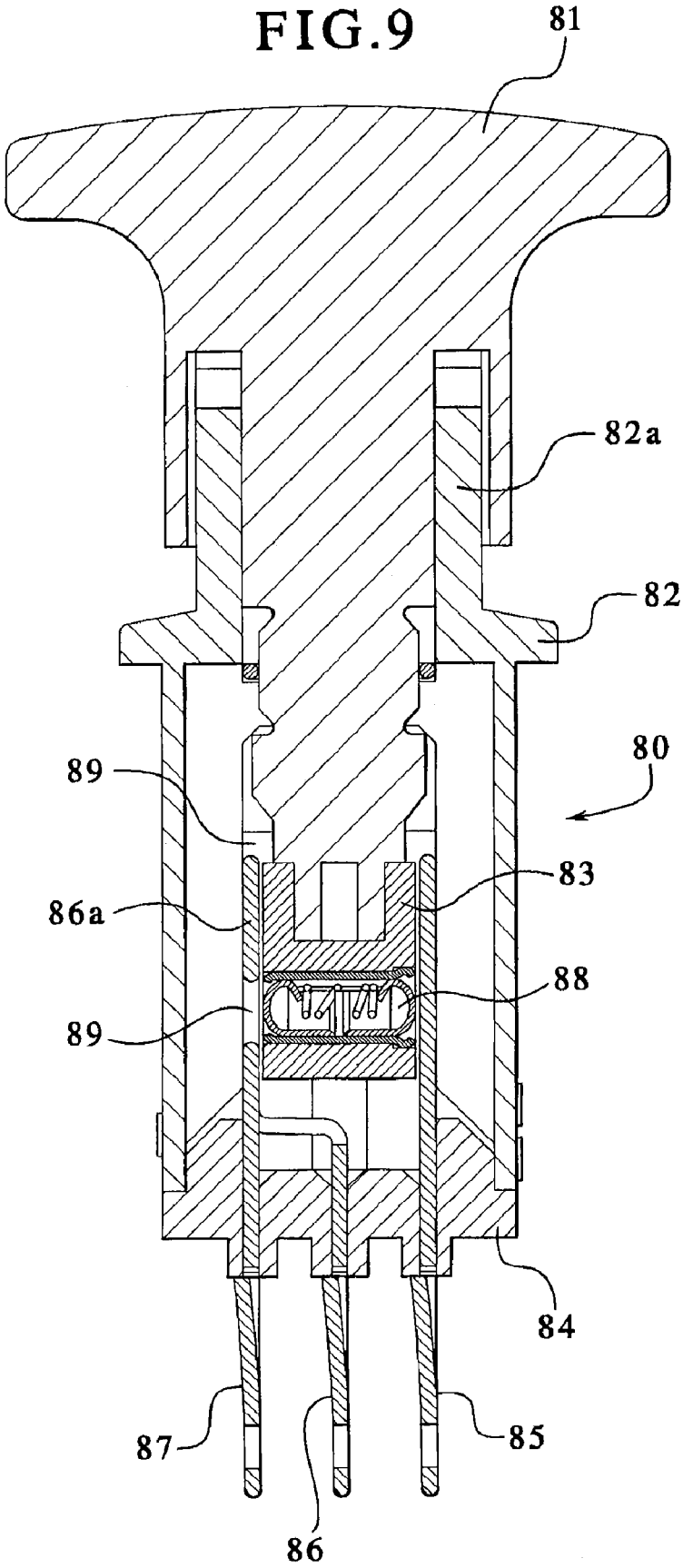
Figure 10:
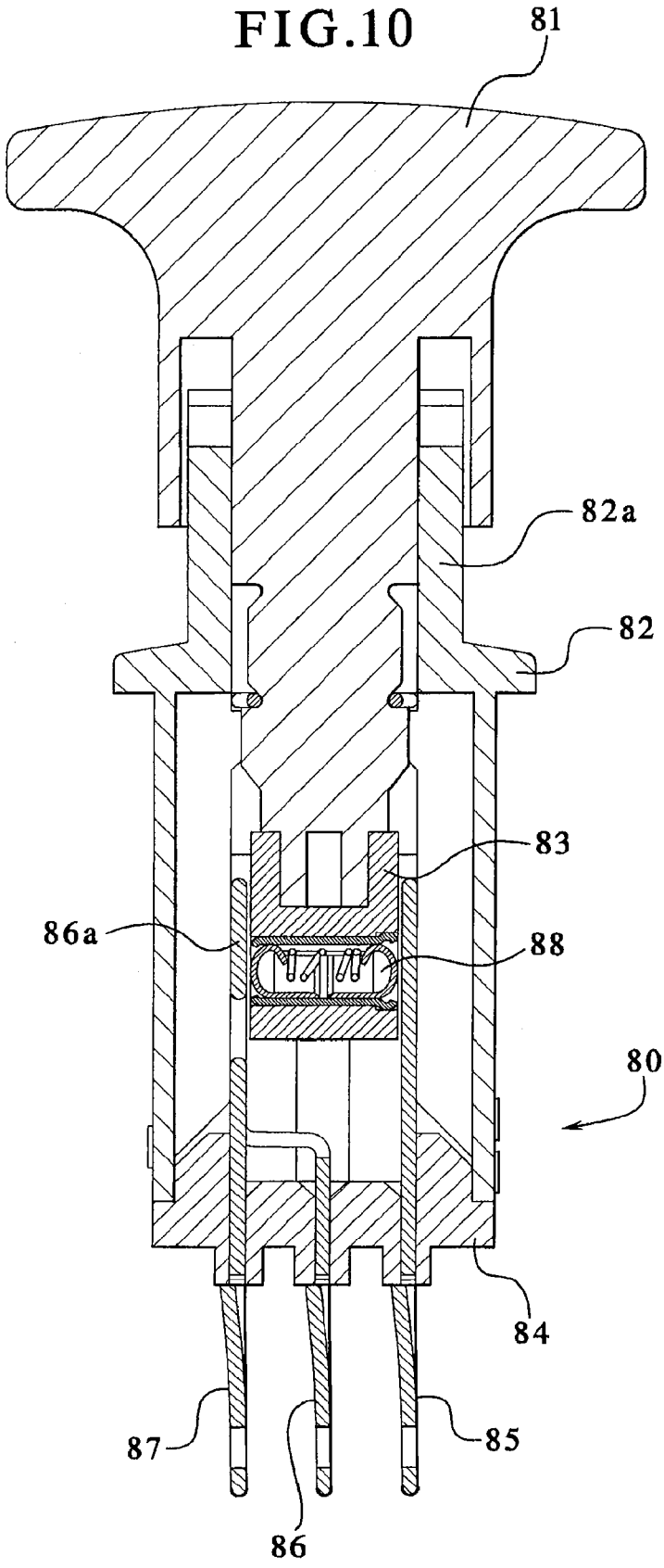

Operation of the contactors with internal angled conductors and the plunger switches is now described in FIGS. 8-10. In FIG. 8, the switch is in the off or un-actuated position. Plunger 81 is in a low position, and is in contact with the upper portions 82*a* of the switch housing 82. Plunger 81 has been assembled to moveable contactor housing 83, which includes one or more contactors 88. Switch housing 82 has been assembled to fixed contacts housing 84. Fixed contacts housing 84 includes at least one common terminal 84, one NO terminal 86, and one NC terminal 87. FIG. 8 depicts electrical contact between the right side of contactor 88 and common terminal 85, and also depicts electrical contact between the left side of contactor 88 and NC terminal 87. Although not apparent from FIG. 8, the remaining terminal, NO terminal 86 is not in electrical contact with common terminal 85.

Figure 11:
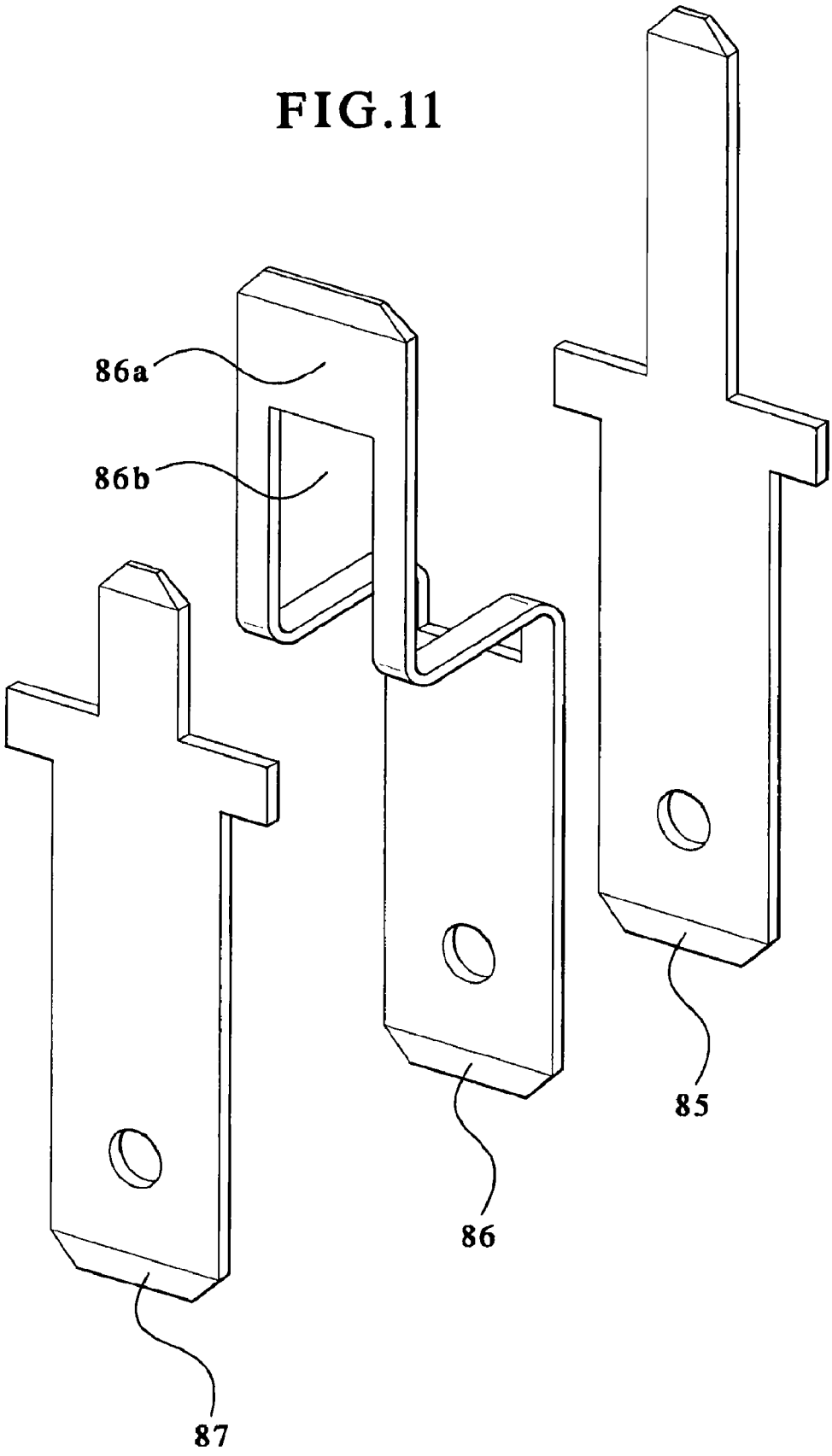
FIGS. 11-12 depict perspective view of contacts useful for switches using contactors with internal conductors at an angle to each other.

In FIG. 9, actuator 81 has been pulled partially upward or out, and the switch is in transition from off or a non-actuated position, to on or an actuated position. In this position, contactor 88 remains in contact with common terminal 85, but the left-hand side of contactor 88 is no longer in electrical contact with NC terminal 87, instead contacting a void 89 above NC terminal 87. In FIG. 10, the actuator or plunger 81 has now been fully pulled out or actuated. The right-hand side of angled actuator 88 is still in contact with common terminal 85. The left-hand side of contactor 88 is now in electrical contact with the upper portion 86*a* of NO terminal 86. Upper portion 86*a* is nested above NC contact 87. The horizontal distance from the common terminal 85 to the upper portion of NC contact 87 is equal to the horizontal distance from the common terminal 85 to the NO contact 86. The NC and NO contacts are displaced vertically to allow for proper connections and operation. The contacts discussed in FIGS. 8-10 are shown in perspective in FIG. 11. NO terminal 86 has a central void 86*b* into which NC contact 87 may nest. This allows the vertical separation of the upper electrical contacts of terminals 86 and 87.

Figure 12:
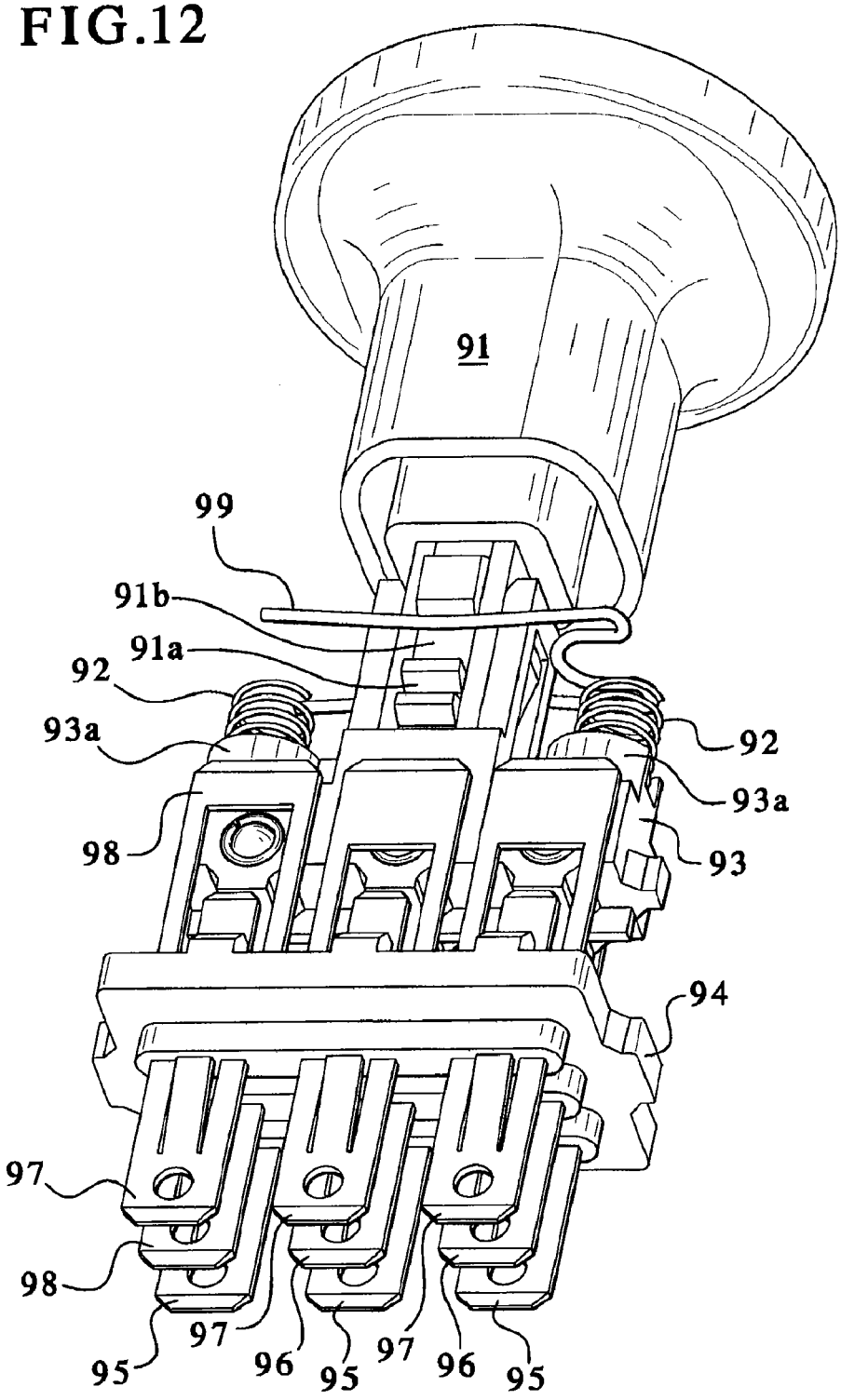

FIG. 12 depicts another switch assembly embodiment. In the embodiment of FIG. 12, plunger 91 is assembled to moveable contact housing 93 for switch actuation. Clip 99 may be used to secure the plunger-moveable contact housing assembly with respect to the switch housing (not shown). The plunger 91 includes an lower detent or slot 91*a* whose width is about the same as the width of the wire that makes clip 99. When the plunger is secured in the non-actuated position, the fit is thus firm. The upper detent or slot 91*b* is significantly wider than the clip wire. If the plunger is secured in the upper slot, for actuation, a user may pull the plunger further upward, thus allowing a contactor to make contact with terminal 98 for momentary operation of a device.

The fixed contacts are mounted in the fixed contact housing 94. Contacts 97 are NO, that is, they are open in the off position but closed as shown in the actuated position. Contact 98 is also NO, but in this embodiment, is also normally closed in the actuated state. Pulling the plunger further upward maintains the closed contact with NO switches 97 while allowing a momentary contact for NO switch 98. Contacts 95 are common and contacts 96 arc NC. Moveable contact housing 93 includes spring bosses 93*a* for springs 92.

In automotive or agricultural applications, this configuration may be useful for momentary activation of a power take off (PTO) device, such as a shaft, the shaft operating an auger, a winch or other power device, which may be operated by an electric clutch. The operator may wish to momentarily rotate the auger or winch, perhaps for an easier hook-up. In other applications, such as for chemical or food processing applications, the operator may wish to jog a pump or other device, perhaps to check its operation or to clear the device.

Figure 13:
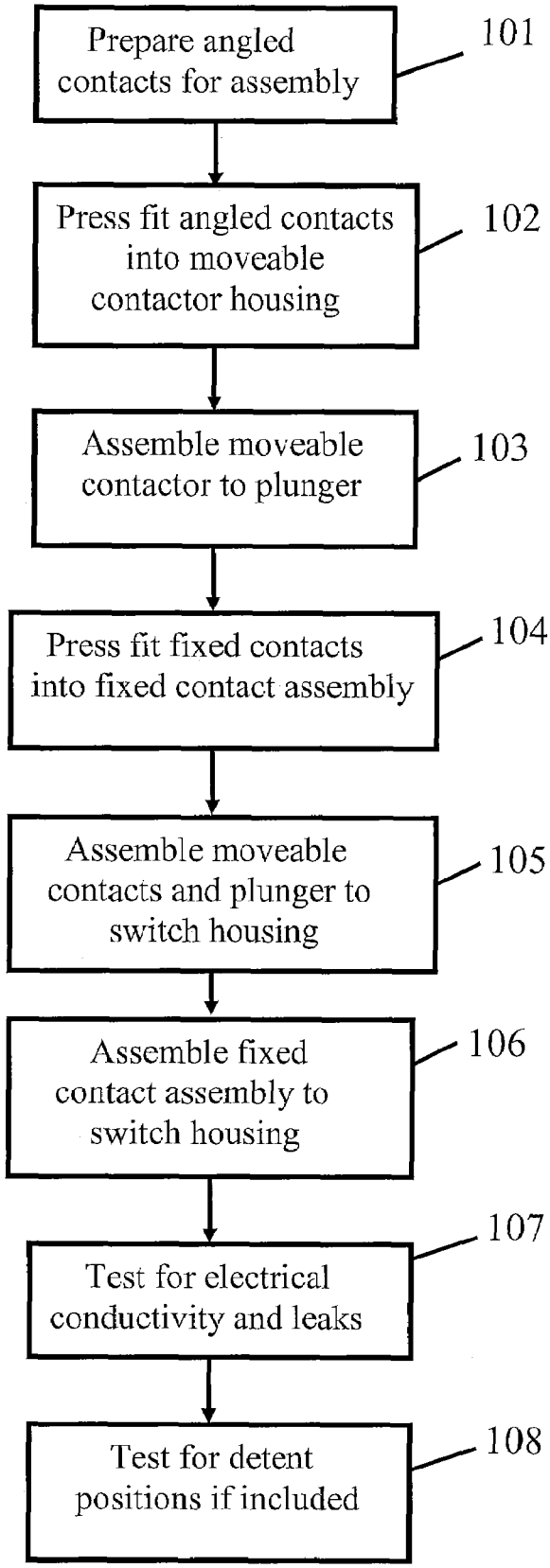
FIG. 13 depicts a flow chart for a method of assembly of a switch using contactor embodiments of the present invention.

There are many ways of preparing contact and switches for the embodiments herein described. One way of preparing such switches and contacts is disclosed in FIG. 13. A first step 101 may be to provide the contactors with internal conductors at an angle as described above, and to clean them, if necessary, before assembly. The contactors are then desirably press fit 102 or otherwise assembled into a moveable contactor housing.

After the moveable contactor housing is assembled with the contactors, the housing is assembled 103 to the plunger. The fixed contacts, such as NC, NO, and common terminals, are then prepared, as by cleaning, and are press fit or otherwise assembled 104 into a fixed contact assembly. The fixed contact assembly and plunger are then assembled 105, 106 to the switch housing. This completes assembly of the main components of the switch. The switch may then be tested 107 for electrical continuity or leaks, and may be tested 108 for detent positions if detents have been molded into the plunger and a retainer clip is provided.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A switch with a plurality of contactors, the switch comprising:

a switch housing;

a fixed contactor mounted to the switch housing, the fixed contactor comprising at least one each of NC, NO and common terminals;

a plunger slidably mounted to the switch housing; and a movable contactor housing connected to the plunger, the moveable contactor housing further including a plurality of contactors, each contactor having a conductive housing, first and second metallic conductors captured at an angle within the conductive housing, a portion of each of the first and second conductors extending beyond the housing, the first and second conductors joined to a spring having first and second ends, the conductive housing and the conductors forming redundant electrical paths, wherein a position of the plunger determines connections made by the contactors between the terminals.

2. The switch according to claim 1, wherein the NC and NO terminals are nested so that one of the conductors is in electrical contact with the NC terminal when the plunger is in a normal position and is in contact with the NO terminal when the plunger is in an actuated position.

3. The switch according to claim 1, wherein one of the plunger and the movable contactor housing further comprises detents for a normal position and for an actuated position, and optionally further comprising a retainer for fitting into the detents to retain the plunger in the normal or actuated positions.

4. The switch according to claim 1, further comprising at least one return spring mounted between the switch housing and the movable contactor housing, the return spring urging the plunger away from the switch housing.

5. The switch according to claim 1, wherein at least one of the NC terminals comprises a momentary-operate terminal.

6. The switch according to claim 1, further comprising a conductive grease applied to at least one of the conductors.

7. A switch with a plurality of contactors, the switch comprising:

a switch housing;

a fixed contactor mounted to the switch housing, the fixed contactor comprising at least one each NC, NO and common terminals;

a plunger slidably mounted to the switch housing; and a movable contactor housing connected to the plunger, the moveable contactor housing further including a plurality of contactors, each contactor having a conductive housing, first and second metallic conductors captured within the conductive housing and joined to first and second ends of a spring inside the conductive housing, the conductors at an angle to a longitudinal axis of the conductive housing and a portion of each of the first and second conductors extending beyond the conductive housing, the conductive housing and the conductors forming redundant electrical paths, wherein a position of the plunger determines connections made by the contactors between the terminals.

8. The switch according to claim 7, wherein ends of the metallic conductors have separate surfaces configured for primary electrical contact and for arcing.

9. The switch according to claim 7, wherein the switch housing further comprises a plurality of mounting clips for mounting the switch to an operating panel.

10. The switch according to claim 7, wherein the metallic conductors contact the conductive housing on both sides of the conductive housing, at about 180°.

11. The switch according to claim 7, wherein the conductive housing has a shape that is generally cylindrical or trilobal.

12. A switch, comprising:

a) a switch housing defining a housing interior with an access opening extending through a wall of the housing to the housing interior; and b) an actuator assembly, comprising i) a plunger configured by the switch housing to translate along a path including a normal position and an actuated position and having a plunger body portion extending through the access opening;

ii) a contactor housing mounted to the plunger; and iii) one or more spring contactors mounted to the contactor housing, each spring contactor having a conductive housing, first and second metallic conductors captured within the conductive housing and joined to first and second ends of a spring inside the conductive housing, the conductors at an angle to a longitudinal axis of the conductive housing and a portion of each of the first and second conductors extending beyond the conductive housing, the conductive housing and the conductors forming redundant electrical paths; and c) a plurality of terminals having conductive surfaces for biased engagement with the one or more contactors to form an electrical path between terminals when the plunger is in the normal or in the actuated position.

13. The switch according to claim 12, wherein the plurality of terminals are mounted within a terminal housing mounted to the switch housing.

14. An electrical contactor for use in a switch, comprising:

a conductive housing;

a spring with first and second ends within the housing; and first and second metallic conductors captured within the housing and partly extending beyond the housing, the conductors at an angle to a longitudinal axis of the conductive housing and joined to the first and second ends of the spring, the housing and the conductors forming redundant electrical paths, and the spring urging the first and second metallic conductors against the housing.

15. The contactor of claim 14, wherein the conductors are roughly in the shape of a bullet with roughly hemispherical ends, and are configured with separate surfaces for primary electrical contact and for arcing.

16. The contactor of claim 14, wherein the spring is conductive and with the conductors form one of the redundant electrical paths.

17. The contactor of claim 14, wherein the spring is a compression spring or a leaf spring.

18. The contactor of claim 14, wherein the conductors comprise a copper alloy, the conductive housing comprises brass, and the spring comprises stainless steel.

19. The contactor of claim 14, further comprising a conductive grease applied to at least one of the housing, the first, and the second metallic conductors.

20. The contactor of claim 14, further comprising a moveable housing and a handle mounted to the moveable housing, wherein at least one contactor is mounted within the moveable housing, and further comprising a switch housing and fixed contacts mounted within the housing, wherein the handle and the moveable housing are configured to position the contactor between the fixed contacts within the housing.

* * * * *